United States Patent [19]

Watanabe et al.

[11] 3,943,848

[45] Mar. 16, 1976

[54] HIGH SPEED PRINTING APPARATUS

[75] Inventors: Akinori Watanabe; Matsusaburo Noguchi, both of Tokyo, Japan

[73] Assignee: Oki Electric Industry Co., Ltd., Tokyo, Japan

[22] Filed: Aug. 7, 1974

[21] Appl. No.: 495,308

[52] U.S. Cl. ..... 101/114; 101/DIG. 13; 355/3 R

[51] Int. Cl.[2] ..... G03G 13/06

[58] Field of Search ..... 101/114, DIG. 13, 1; 355/3 R; 137/609, 610, 625.12

[56] References Cited

UNITED STATES PATENTS

| | | | |
|---|---|---|---|
| 1,138,994 | 5/1915 | Steele | 137/625.12 |
| 2,369,602 | 2/1945 | Petty | 101/114 |
| 3,363,545 | 1/1968 | Johnson | 101/1 |
| 3,779,166 | 12/1973 | Pressman | 101/DIG. 13 X |

*Primary Examiner*—Harland S. Skogquist

*Attorney, Agent, or Firm*—Peter L. Berger

[57] ABSTRACT

In a high speed printing apparatus in which ions produced between electrodes, to which is applied a high voltage, are passed through mists of ink, and particles of ink adhere to the ions to cause the printing operation to be conducted, said apparatus is characterized in that the air is supplied in such a way that only the desired printing width is left between the recording paper and the ink mists.

6 Claims, 6 Drawing Figures

HIGH SPEED PRINTING APPARATUS

BACKGROUND OF THE INVENTION

Increasing demand for high speed operation of the central processing unit of an electronic computer requires high speed operation of the output device, i.e. a high speed printing device, and various types of printing systems have been developed.

In one typical printing system, there is a system is which inks are supplied to the nozzle under a slight pressure so that the ink is projected in a hemispherical shape at the tip of the nozzle and is drawn in droplet form by applying an electric field between an accelerating electrode positioned a few milimeters ahead of the nozzle and the nozzle. The droplets of the ink then move toward the surface of the recording paper by applying a high electric field between the nozzle and the platen, said droplets of the ink being electrostatically deflected in both directions (right and left) to print characters or symbols on the surface of the recording paper.

As another typical printing apparatus, there is a system in which the ions produced between the electrodes receiving a high voltage are passed through the ink mists and the particles of the ink selectively adhere to the surface of the recording paper to cause printing. The present invention relates to this latter type of system.

The printing system will be described in detail. Corona discharge is utilized for ionization of the air. Application of a few thousand volts to very thin conductors causes corona discharge, and molecules such as oxygen, nitrogen or the like in the air surrounding this conductors are ionized. The ions produced around these conductors are attracted to the platen side by an electric field existing between the platen of the back surface of the recording paper and the conductor.

The ink is agitated by supersonic waves and changed into the mists having molecules 5 to $20\mu$ diameter and being suspended in the air. The mist is fed between the platen and a source of corona discharge by pneumatic pressure in the same direction and at the same speed as that of the paper being fed. Thus, the ions project into the ink mist, adhere around the mist, move in the combined directions of the electrostatic force and the mist stream and, adhere to the recording paper positioned between the platens and are impressed thereon.

The configuration of this system is shown in the block diagram of FIG. 1 and comprises two parts: a main body 11 and a control part 12, the main body 11 having a paper feeding device 13, printing part 14, mist generating part 15, ink circulating device 16 and mist treatment device 17, and the control part 12 having control circuit 18 and driving circuit 19 for the mist generating device.

Thus, in the above-mentioned high-speed printing apparatus, the printing capacity, i.e. a number of characters which can be printed in one row, is set at approximately 136 characters, so that if the printing operation is conducted on the recording paper having a narrow printing width, there are some disadvantages in that disturbance of the air stream at both end portions of the recording paper by the paper feeding sprockets holes or the ends of the paper cause the portions adjacent to the sprocket holes of the recording paper or back bars and the aperture plate or the like to become soiled so that the characters become blurred, faded and unclear.

Object

It is an object of the present invention to provide a system in which the end portions of the recording paper are detected by a suitable means such as mechanical, electrical and optical means, and air curtains are provided so as to leave only the desired printing width of the recording paper available for the mist of ink and thereby, the correct stream of the ink mists is always maintained within the printing width.

It is a further object of the present invention to provide such a system in which the blowing pressure is always maintained constant irrespective of the change of the blowing width and thereby the ink mist flow is prevented from being disturbed.

It is still a further object of the present invention to provide such a system in which the structure of the fan or blowing mechanism is small.

SUMMARY OF THE PRESENT INVENTION

The present invention provides such a system in which a width of the air feeding port is adjusted so as to leave only the desired printing width between the recording paper and the mists of ink available for the blowing air and the air blow is separately supplied to the printing surface and the surface which does not require printing.

DETAILED DESCRIPTION OF THE INVENTION

Figure 1:
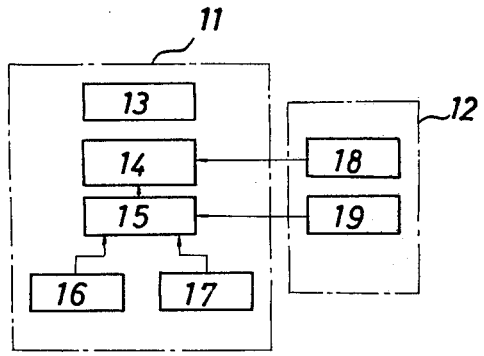
FIG. 1 is a diagramatic view illustrating the principle of the present invention.

At first, describing the printing operation in brief, control electrode 102 of an aperture plate 101 is selected to receive a predetermined voltage, in accordance with the printing pattern made by a character register (not shown). Ions are produced around an anode 103 and move toward a cathode 104; some of them are obstructed by aperture plate 101 and some of them are pass through a through-hole 105 and move into an ink mist stream 106. At this time, the ions attached with to the particles of ink are further moved toward the cathode 104 and are absorbed on recording paper 107 and thereby dots are printed thereon. This printing operation is made to be a main scan operation and the feeding of the recording paper 107 is made to be a sub-scan operation, and thereby the desired characters are printed in dots.

Figure 2:
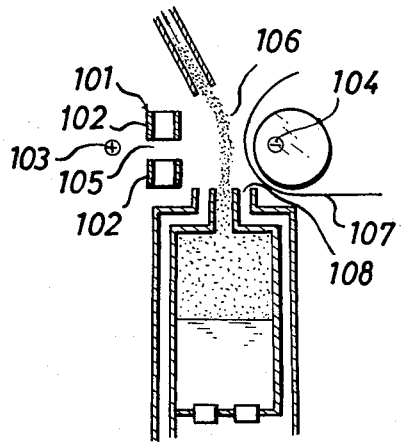
FIG. 2 is a side elevational view, in section, of one embodiment of the present invention.
Figure 3:
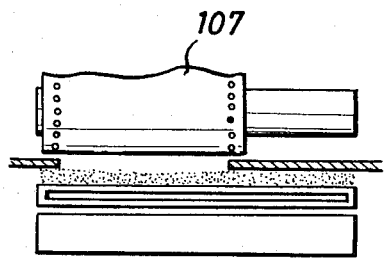
FIG. 3 is a plan view of the printing portion of the system, of which the inlet port for the mists of ink in the embodiment in FIG. 2 is eliminated.
Figure 4:
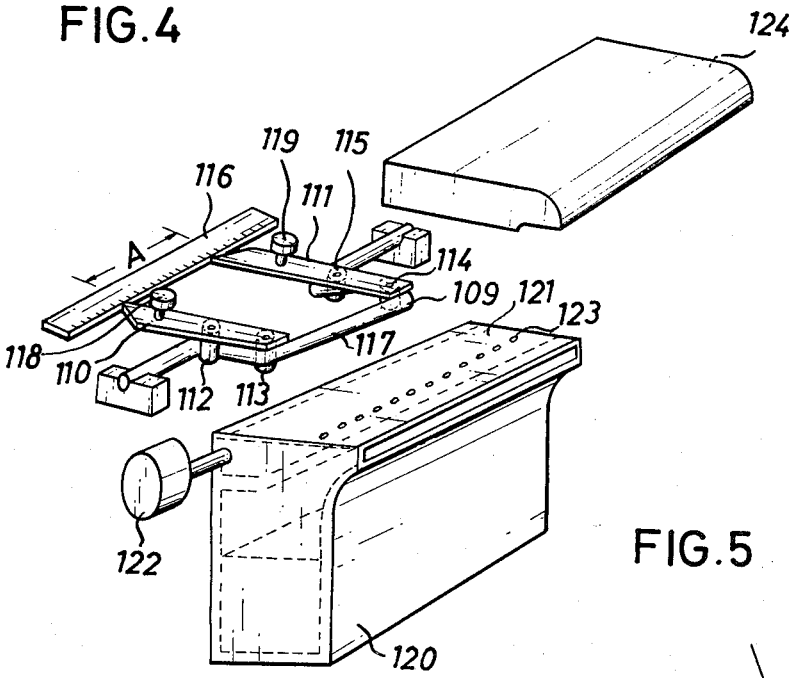
FIG. 4 is an exploded schematic perspective view of another embodiment of the present invention.
Figure 5:
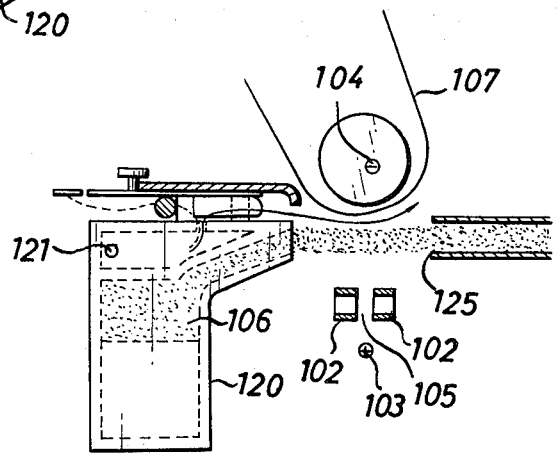
FIG. 5 is a partial broken away side elevational view of the assembly of the embodiment shown in FIG. 4.
Figure 6:
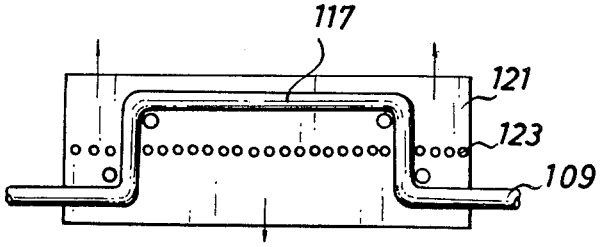
FIG. 6 is a plan view showing the relationship between the belt and the air supplying tank.

Thus, as shown in FIGS. 2 and 3, air supplying ports 108 are constructed so as to adapt the ports to the printing width. Further specific embodiments thereof are shown in FIGS. 4 to 6, in which 107 is the recording paper, 109 is a belt having a circular section in which both ends are attached to the printing apparatus, 110 and 111 are pointer having guide rollers 112, 113 and 114, 115 respectively engaging with belt 109 at about a central portion thereof and one end thereof, 116 is an indicating plate showing a printing width a with movement of the pointers 110 and 111 and U-shaped portion 117 of the belt 109 and being adjusted to the same size as that of the printing width a by movement of said pointers 110 and 111.

The numerals 118 and 119 designate knobs which are used when the pointers 110 and 111 are moved, 120 designates a mist tank, 106 the ink mist, 121 an air supplying tank constructed integral with said mist tank and provided with a plurality of holes 123 for discharging the air supplied by the fan 122, 124 is a cover provided to cover the mist tank 120 over the pointers 110 and 111, and 125 is an inlet port for ink mist.

According to the high speed printing machine comprising the components described above, first, the pointers 110 and 111 are set on the indicating plate 116 in accordance with the printing width A of the recording paper 107. Thus, the U-shaped portion 117 of the belt 109 is set to the printing width A. The air transferred onto the mist tank 120 from the fan mechanism 122 through the air supplying tank 121 are, as shown in FIG. 6, divided into two flows, namely one for U-shaped portion 117 and the other for another portion. The air discharged into the U-shaped portion 117 of the belt 109 flows towards the indicating plate 116 and the air discharged outside the U-shaped portion 117 flows out towards the recording paper 107. That is to say, the air is transferred toward the recording paper, except at the place where the printing operation is conducted.

As described above, in accordance with the present invention, one continuous belt is set to the printing width by two sets of guide rollers provided on the right and left sides of the printing apparatus, air is transferred between the recording paper and ink mists in the region where the printing operation is not conducted, and in the region of printing, the air under constant pressure is always transferred rearward away from the printing recording paper.

What we claim is:

1. For a high speed printing apparatus which performs its printing operation by charging ink droplets of an ink mist when said mist passes a pair of electrodes such that said droplets adhere to ions, said ink particles ionically charged being selectively adsorbed on a recording paper to form printed symbols, curtain means for blocking said ionically charged ink droplets from the portion of said recording paper where printing does not occur, said curtain means comprising an air stream, said air stream forming a barrier in front of said portion of said recording paper where printing does not occur.

2. Curtain means according to claim 1, comprising means for directing said air stream between said recording paper and said ink mist.

3. Curtain means according to claim 1, comprising means for adjusting the position of said air stream to accommodate different widths of printing area.

4. Curtain means according to claim 2, comprising blower means to form an air pressure and divider means for dividing said pressure to form said air stream forming said barrier.

5. Curtain means according to claim 4, comprising duct means extending beyond each end of the printing width of said recording paper, said duct means being connected with said blower means, said divider means separating said duct means into a printing portion and a portion where printing does not occur.

6. Curtain means according to claim 5, wherein said duct means extends in a line, said divider means comprises a movable belt, said movable belt traversing said line of duct means at said portion where printing occurs to form said portion where printing does not occur and form said air curtain.

* * * * *